US006740849B1

(12) United States Patent
Cho

(10) Patent No.: US 6,740,849 B1
(45) Date of Patent: May 25, 2004

(54) TWO-LAYER DYNAMIC HEAT CONVECTION WATER GLASS BOTTLE

(76) Inventor: Wen-Cheng Cho, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/350,942

(22) Filed: Jan. 22, 2003

(51) Int. Cl.[7] ..... H05B 1/00
(52) U.S. Cl. ..... 219/200; 362/101
(58) Field of Search ..... 219/200, 220, 219/521, 432, 535, 281; 362/101, 96, 84; 40/410, 406; 249/78; 215/12.2, 11.1

(56) References Cited

U.S. PATENT DOCUMENTS 3,638,820 A * 2/1972 Misu ..... 215/12.2
4,215,843 A * 8/1980 Gay et al. ..... 249/78
4,495,404 A * 1/1985 Carmichael ..... 219/281
4,716,278 A * 12/1987 Cappe et al. ..... 219/521
5,291,674 A * 3/1994 Torrence ..... 40/410
5,504,663 A * 4/1996 Tucker ..... 362/101
5,549,543 A * 8/1996 Kim ..... 600/169
5,780,819 A * 7/1998 Fabrikant et al. ..... 219/535
5,803,580 A * 9/1998 Tseng ..... 362/96
5,928,542 A * 7/1999 Miguelino ..... 219/432
6,186,637 B1 * 2/2001 Murrietta ..... 362/101
6,213,616 B1 * 4/2001 Chien ..... 362/84
6,416,197 B1 * 7/2002 Chang ..... 362/96
6,461,014 B1 * 10/2002 Lin ..... 362/101
6,539,654 B2 * 4/2003 Lin ..... 40/406
6,604,835 B2 * 8/2003 Zale ..... 362/101
6,631,819 B1 * 10/2003 Ghanem ..... 215/11.1

* cited by examiner

*Primary Examiner*—Ehud Gartenberg
*Assistant Examiner*—L Fastovsky

(57) ABSTRACT

A two-layer dynamic heat convection water glass bottle comprises a bottle body with an opening at a bottom thereof and an airtight bottom cover. An inner chamber of the bottle body has an inner bottle at a center thereof. A bottom of the inner bottle is fixed to the bottom cover. A space between the bottle body and the inner bottle is filled with first sterile liquid and first decorating sparkling pieces. The inner bottle is filled with second sterile liquid and second decorating sparkling pieces. An inner chamber of the inner bottle is not communicated with the space between the inner bottle and the bottle body. The bottom cover is heated by the heat source through radiation and convection. When heated, the sterile liquid in the bottle body and inner bottle is in an unstable condition, so that the first and second decorating sparkling pieces flow cyclically.

11 Claims, 4 Drawing Sheets

TWO-LAYER DYNAMIC HEAT CONVECTION WATER GLASS BOTTLE

FIELD OF THE INVENTION

The present invention relates to glass bottles, and particularly to a two-layer dynamic heat convection water glass bottle.

BACKGROUND OF THE INVENTION

In the prior art, a glass water ball includes a bottle body having an opening at a bottom thereof. The opening is sealed by a rubber plug. An inner space of the bottle body is filled with liquid and a plurality of sparkle decorating pieces are sunk in the liquid.

To have a better effect, a driving means is installed at a bottom of the water ball to drive the liquid in the water ball so that the decoration pieces in the liquid can flow through the convection of the liquid. In general, the driving means is an electric device which must be powered by an outer electric power source so as to induce noises and thus it is easy to be damaged.

However, from thermodynamics, it is known that heat could generate water flow so that the sparkle decorating pieces can present a beautiful outlook. Moreover, the cost is low. The current used water ball is not suitable to be heated since the rubber plug can not be heated. Thus a novel design is necessary so that it can be heated to cause the decorating pieces to flow in the liquid.

SUMMARY OF THE INVENTION

Accordingly, the primary object of the present invention is to provide a two-layer dynamic heat convection water glass bottle which comprises a bottle body with an opening at a bottom thereof and an airtight bottom cover; an inner chamber of the bottle body having an inner bottle at a center thereof, A bottom of the inner bottle is fixed to the bottom cover. A space between the bottle body and the inner bottle is filled with first sterile liquid and first decorating sparkling pieces. The inner bottle is filled with second sterile liquid and decorating sparkling pieces. An inner chamber of the inner bottle is not communicated with the space between the inner bottle and the bottle body. The bottom cover is made of heat conductive rigid materials; and the bottle body is positioned on a heat seat which has an upper opening. A heat source is placed in the heat seat; the heat source is positioned near, but not in contact with the bottom cover of the bottle body. A lateral wall of the heat seat is formed with vents. The bottom cover is heated by the heat source through radiation and convection. When heated, the sterile liquid in the bottle body and inner bottle is in an unstable condition, i. e., lower sides of the bottle body and the inner bottle are cool and upper sides thereof are hot so that the first and second decorating sparkling pieces flow cyclically.

The various objects and advantages of the present invention will be more readily understood from the following detailed description when read in conjunction with the appended drawing.

BRIEF DESCRIPTION OF THE PREFERRED EMBODIMENTS

Figure 1:
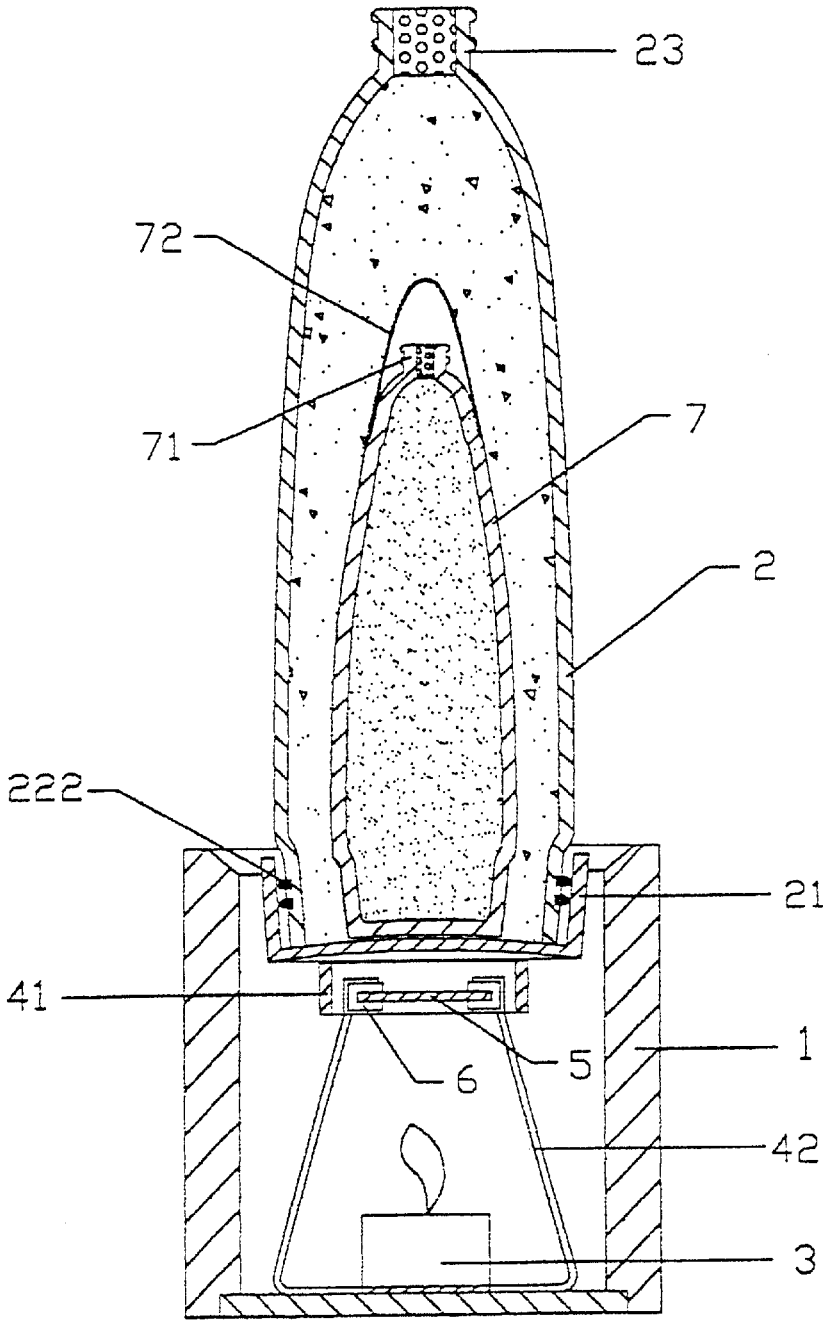
FIG. 1 is a cross section view of the two-layer dynamic heat convection water glass bottle according to the present invention.

The two-layer dynamic heat convection water glass bottle of the present invention will be described herein with the reference drawings. Referring to FIG. 1, the two-layer dynamic heat convection water glass bottle according to the present invention includes a bottle body 2 with an opening at a bottom thereof and an airtight bottom cover 21.

An inner chamber of the bottle body 2 has an inner bottle 7 at a center thereof. The bottom of the inner bottle 7 is fixed to the bottom cover 21. A space between the bottle body 2 and the inner bottle 7 is filled with sterile liquid A and decorating sparkling pieces B. The inner bottle 7 is filled with sterile liquid A1 and decorating sparkling pieces B1. The inner chamber of the inner bottle 7 is not communicated with the space between the inner bottle 7 and the bottle body 2. Therefore space and the inner bottle 7 are independent. Liquids therein flow independently.

Since it is desired to heat a bottom of the bottle, the conventional tuber plug is not used in the bottom cover 21, but rigid materials, such as glass, is used. The glass bottom cover 21 will not deform due to heating. Furthermore, heat at an outer surface of the bottle is transferred to the liquid in the space between the bottle body 2 and the inner bottle 7.

In the present invention, the colors and specific gravities of liquids A and A1 may be different or identical. The shape and colors of decorating sparkling pieces B and B1 may be different or identical.

To have a preferred effect, a preferred embodiment will be described herein. The liquid A and liquid A1 have different colors, but have the same specific gravity. The decorating sparkling pieces B in the liquid A are golden pieces and the liquid A1 is liquid wax. The decorating sparkling pieces B and B1 have different color and shape.

Figure 2:
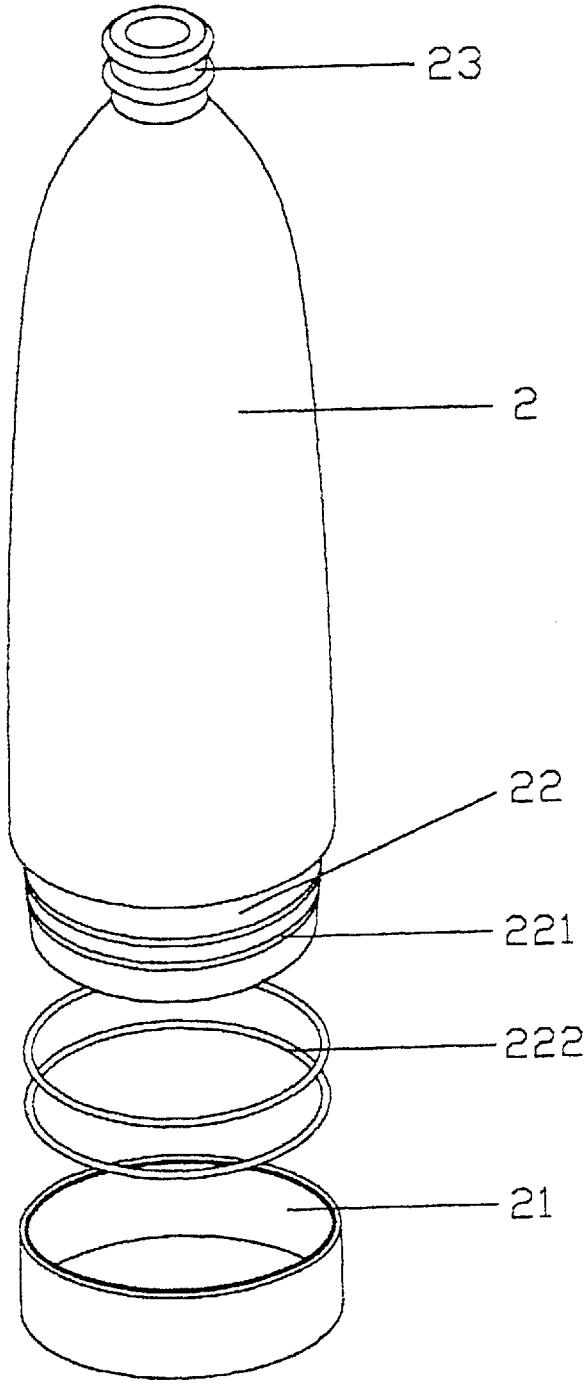
FIG. 2 is an exploded schematic view includes the bottle body, heat source and suspending frame of the present invention.
Figure 4:
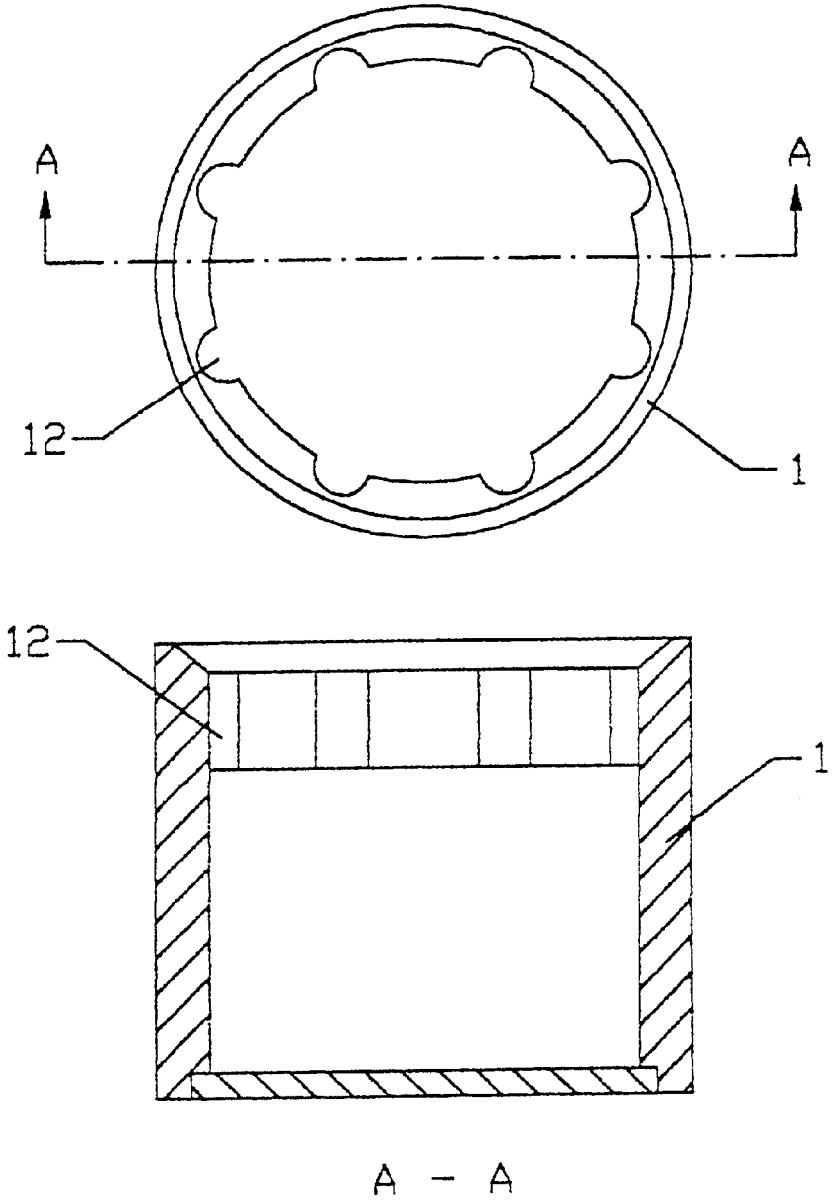
FIG. 4 is a structural schematic view showing the heat seat of the present invention.

Referring to FIG. 1, the bottle body 2 is placed on the heat seat 1 with an opening 23 at the upper side. The heat seat 1 is placed with a heat source therein. The heat source is placed upon the bottom cover 21 near, but not in contact with the bottle body 2. The bottom cover 21 is heated by the heat source by radiation and convection. The sterile liquid in the bottle body 2 and inner bottle 7 is in an unstable condition, i. e., lower sides of the bottle body 2 and the inner bottle 7 are cool and upper sides thereof are hot. The lateral wall of the heat seat 1 has a plurality of vents 12 (referring to FIG. 4). The bottom cover 21 is heated by radiation and convection. The sterile liquids in the bottom cover 21 and inner bottle 7 are cool in the lower sides and hot in the upper sides, namely in an unstable condition. The convection is formed and the decorating sparkling pieces in the liquid flows cyclically. With reference to FIG. 2, since liquid A and liquid A1 have different specific gravity, the speeds of liquid convections of the two liquids are different. Thus, inner bottle 7 and the space between the inner bottle 7 and the bottle body 2 present different colors and different liquid flows. The outlook of the two-layer dynamic heat convection water glass bottle of the present invention is beautiful.

When the temperatures of the heat source and the bottom cover 21 are increased to a predetermined temperature, the heat dissipation and absorption will be in an equilibrium condition. A suitable heat source is selected and is placed in a predetermined position in the heat seat 1. The heat equilibrium temperature of heat source is between 250° C. to 320° C., preferably, 300° C. The heat equilibrium temperature of bottom cover 21 is between 50° C. to 60° C., preferably, 55° C. Thus, the bottle body 2 and inner bottle 7 will not break out due to high temperature. Vents at a top of the heat seat 1 are used to prevent heat from accumulating in the interior of the heat seat 1 so as to have a preferred heat equilibrium.

The heat source may be electric silks of proper power, which is placed in the suspending frame 4 within the heat seat 1. The conductive wires of the electric silks are led out from a lateral wall of the heat seat 1. The heat source may be a candle. That is, a suspending frame 4 is installed within the heat seat 1, and a heat tolerate glass sheet 5 is clamped in the frame 4. A candle 3 is placed on a bottom of the suspending frame 4. With reference to FIG. 2, the suspending frame 4 has three legs 42. The lower ends of the legs are expanded to occupy a larger area and then are reduced upwards. A horizontal ring 41 is fixed at a top of the three legs 42, as shown in FIG. 2. The ring 41 has a predetermined height. A top of the horizontal ring 41 is higher than the heat source with a distance of 0.5 to 1.0 cm; and the bottom cover of the bottle body is placed on the horizontal ring.

A heat-tolerant glass piece 5 is fixed to the bottom of the ring 41 by the clip 43 of each ring 41 to be at a center portion of the suspending frame 4. The bottom cover 21 of the bottle body 2 is horizontally placed on a top of the horizontal ring 41. A bottom of the bottom cover 21 is higher than the glass piece 5 with a length of 0.5 to 1.5 cm, preferably 1.0 cm. A silicide heat isolating pad 6 is formed between the clip 43 and bottom cover 21 so as to prevent heat of the glass piece 5 from being transferred to the suspending frame 4.

The candle 3 heats the heat tolerate glass piece 5 so that by radiation and convection, the heat transmits through the bottle body 2 and the bottom cover 21 of the inner bottle 7 to heat the bottom 21 used commonly by the bottom cover 21 and the inner bottle 7. Thereby, liquid in the bottle body 2 and inner bottle 7 will flow continuously and thus the decorating sparkling pieces B and B1 will present beautiful decorating effect.

Figure 3:
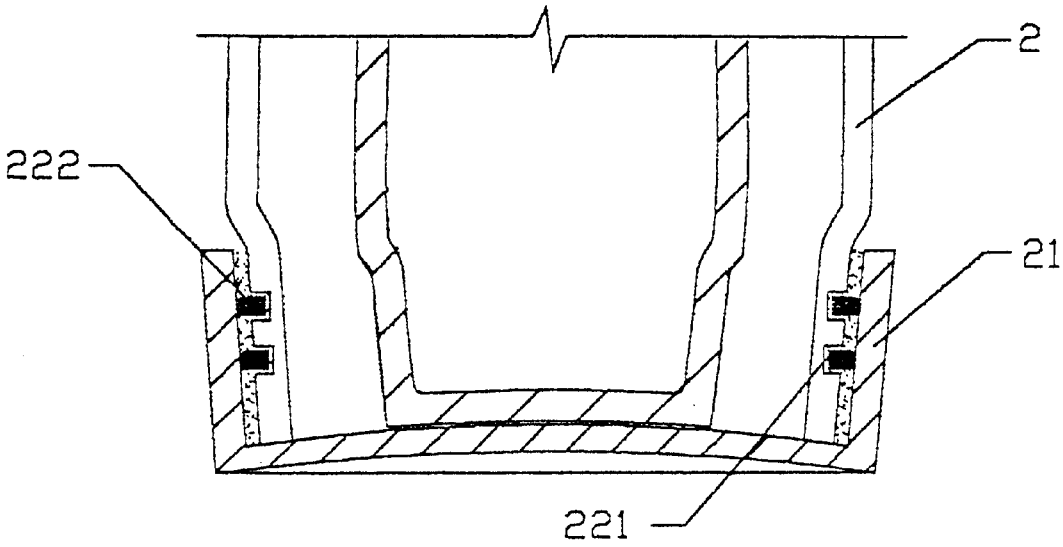
FIG. 3 is a cross section view showing the bottle body and the bottom cover of the present invention.

Referring to FIGS. 2 and 3, the bottom cover 21 is a round container with an opening at an upper side. An inner diameter of the lateral wall is reduced from an upper side to a lower side. A bottom of the bottle body 2 is vertically extended with a neck portion 22 which has a configuration with respect to that of the bottom cover 21. An annular slot 221 is formed on the neck portion 22. A seal ring 222 is placed in the annular slot 221, but a part of the seal ring 222 protrudes out of the annular slot 22.

In assembly, the neck portion 22 is inserted into the bottom cover 21. The protruding portion of the seal ring 222 is extruded by an inner side of the bottom cover 21 so as to form an airtight engagement. An outer wall of the neck portion 22 and an outer wall of the bottom cover 21 are stuck by glue so that the two are firmly secured.

Referring to FIG. 1, the lower wall of the inner bottle 7 is fixed to a center portion of the bottom cover 21 by gluing. The tops of the bottle body 2 and the inner bottle 7 are installed with openings 23 and 71, respectively. In assembly the two-layer dynamic heat convection water glass bottle of the present invention, the inner bottle 7 is firstly fixed to the middle section of the bottom cover 21. The sterile liquid A1 and decorating sparkling pieces B1 are filled into the opening 71. Then the opening 71 is sealed by a plug. To have a beautiful outlook, the opening 71 may be covered with a top cover 72 by gluing. Then the sterile liquid A and decorating sparkling pieces B are filled into the opening 23. Then the opening 23 is sealed by a plug.

To improve the thermodynamic property at the bottom of the present invention, as shown in FIG. 3, a bottom of the bottom cover 2 is upwards concave at a center portion thereof.

The present invention is thus described, it will be obvious that the same may be varied in many ways. Such variations are not to be regarded as a departure from the spirit and scope of the present invention, and all such modifications as would be obvious.

What is claimed is:

1. A two-layer dynamic heat convection water glass bottle comprising a bottle body with an opening at a bottom thereof and an airtight bottom cover; an inner chamber of the bottle body having an inner bottle at a center thereof; characterized in that:

a bottom of the inner bottle is fixed to the bottom cover; a space between the bottle body and the inner bottle is filled with first sterile liquid and first decorating sparkling pieces; the inner bottle is filled with second sterile liquid and second decorating sparkling pieces; an inner chamber of the inner bottle is not communicated with the space between the inner bottle and the bottle body;

the bottom cover is made of heat conductive rigid materials; the bottle body is positioned on a heat seat which has an upper opening; a heat source is placed in the heat seat; the heat source is positioned near, but not in contact with the bottom cover of the bottle body, a lateral wall of the heat seat is formed with vents;

the bottom cover is heated by the heat source through radiation and convection; when heated, the sterile liquid in the bottle body and inner bottle is in an unstable condition, i. e., lower sides of the bottle body and the inner bottle are cool and upper sides thereof are hot so that the first and second decorating sparkling pieces flow cyclically.

2. The two-layer dynamic heat convection water glass bottle as claimed as 1, wherein the heat source is electric silks which are placed in the suspending frame within the heat seat; and conductive wires of the electric silks are led out from a lateral wall of the heat seat.

3. The two-layer dynamic heat convection water glass bottle as claimed as 1, wherein a suspending frame is installed within the heat seat, and a heat tolerate glass sheet is clamped in the frame; a candle is placed on a bottom of the suspending frame; a heat-tolerant glass piece is fixed to a bottom of the ring by a clip of each ring to be at a center portion of the suspending frame; a heat isolating pad is placed between the suspending frame and the heat tolerate glass sheet; the candle heats the heat tolerate glass sheet directly and then the bottom cover used by the bottle body and inner bottle is heated indirectly by radiation and convection.

4. The two-layer dynamic heat convection water glass bottle as claimed as 2, wherein a horizontal ring is fixed at a top of the suspending frame; a top of the horizontal ring is higher than the heat source with a distance of 0.5 to 1.0 cm; and the bottom cover of the bottle body is placed on the horizontal ring.

5. The two-layer dynamic heat convection water glass bottle as claimed as 3, wherein a horizontal ring is fixed at a top of the suspending frame; a top of the horizontal ring is higher than the heat source with a distance of 0.5 to 1.0 cm; and the bottom cover of the bottle body is placed on the horizontal ring.

6. The two-layer dynamic heat convection water glass bottle as claimed as 1, wherein the bottom cover is a round container with an opening at an upper side; an inner diameter of the lateral wall of the bottom cover is reduced from an upper side to a lower side; a bottom of the bottle body is vertically extended with a neck portion which has a configuration with respect to that of the bottom cover; an annular slot is formed on the neck portion; a seal ring is placed in the annular slot, but a part of the seal ring protrudes out of the annular slot;

in assembly, the neck portion is inserted into the bottom cover; the protruding portion of the seal ring is extruded by an inner side of the bottom cover so as to form an airtight engagement; an outer wall of the neck portion and an outer wall of the bottom cover are stuck by glue so that the two are firmly secured.

7. The two-layer dynamic heat convection water glass bottle as claimed as 1, wherein a bottom of the inner bottle and the bottom cover are stuck by gluing.

8. The two-layer dynamic heat convection water glass bottle as claimed as 1, wherein the suspending frame is formed by three legs; lower ends of the three legs are expanded outwards.

9. The two-layer dynamic heat convection water glass bottle as claimed as 1, wherein a bottom of the bottom cover is upwards concave at a center portion thereof.

10. The two-layer dynamic heat convection water glass bottle as claimed as 1, wherein each top of the bottle body and inner bottle has an opening and each opening is sealed by a plug.

11. The two-layer dynamic heat convection water glass bottle as claimed as 1, wherein a heat equilibrium temperature of heat source is between 250° C. to 320° C., preferably, 300° C. ;and a heat equilibrium temperature of the bottom cover is between 50° C. to 60° C., preferably, 55° C.

* * * * *